US011940174B2

(12) United States Patent
Yada et al.

(10) Patent No.: US 11,940,174 B2
(45) Date of Patent: Mar. 26, 2024

(54) HEAT-EXCHANGER FIXING PLATE AND INDOOR UNIT OF AIR-CONDITIONING APPARATUS

(71) Applicant: Mitsubishi Electric Corporation, Tokyo (JP)

(72) Inventors: Mizuki Yada, Tokyo (JP); Hisanori Ikeda, Tokyo (JP); Takuya Niimura, Tokyo (JP); Ryosuke Taoka, Tokyo (JP); Yosuke Katayama, Tokyo (JP); Yusuke Tatara, Tokyo (JP); Yuto Taniguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 358 days.

(21) Appl. No.: 17/432,650

(22) PCT Filed: Apr. 23, 2019

(86) PCT No.: PCT/JP2019/017198
§ 371 (c)(1),
(2) Date: Aug. 20, 2021

(87) PCT Pub. No.: WO2020/217307
PCT Pub. Date: Oct. 29, 2020

(65) Prior Publication Data

US 2022/0163232 A1 May 26, 2022

(51) Int. Cl.
*F24F 13/30* (2006.01)
*F24F 1/60* (2011.01)
*F24F 13/20* (2006.01)

(52) U.S. Cl.
CPC ..... *F24F 13/30* (2013.01); *F24F 1/60* (2013.01); *F24F 13/20* (2013.01)

(58) Field of Classification Search
CPC ..... F24F 13/30; F24F 1/60; F24F 13/20
(Continued)

(56) References Cited

U.S. PATENT DOCUMENTS

2003/0159803 A1* 8/2003 Hansen ..... F24F 1/0025 165/59
2007/0053504 A1* 3/2007 Sato ..... H04M 1/0214 455/414.3

(Continued)

FOREIGN PATENT DOCUMENTS

CN 204787167 U 11/2015
EP 3098524 A1 11/2016

(Continued)

OTHER PUBLICATIONS

Office Action dated Jun. 30, 2022 issued in corresponding CN Patent Application No. 201980095278.2 (and English translation).

(Continued)

*Primary Examiner* — Christopher Garft
(74) *Attorney, Agent, or Firm* — POSZ LAW GROUP, PLC

(57) ABSTRACT

A heat-exchanger fixing plate fixes a side portion of a heat exchanger to a housing panel of an air-conditioning apparatus, the heat exchanger including a heat radiation fin and a heat transfer tube. The heat-exchanger fixing plate includes a heat-exchanger support portion facing the side portion of the heat exchanger, and having an insertion hole through which a hairpin portion of the heat transfer tube of the heat exchanger is inserted; and a housing-panel fixing portion separate from and fitted to the heat-exchanger support portion fastened with a screw to the housing panel such that the heat exchanger is fixed to the housing panel. The housing-panel fixing portion is made of material having a higher mechanical strength than that of the heat-exchanger support portion, and the heat-exchanger support portion is (Continued)

made of the material having a lower friction coefficient than that of the housing-panel fixing portion.

5 Claims, 6 Drawing Sheets

(58) Field of Classification Search
USPC ..... 248/672
See application file for complete search history.

(56) References Cited

U.S. PATENT DOCUMENTS

| | | | | |
|---|---|---|---|---|
| 2009/0104949 | A1* | 4/2009 | Sato | H04M 1/0214 439/449 |
| 2016/0033161 | A1* | 2/2016 | Koyanagi | F24F 1/0068 312/236 |

FOREIGN PATENT DOCUMENTS

| | | | |
|---|---|---|---|
| JP | H10-111007 | A | 4/1998 |
| JP | 2003-042478 | A | 2/2003 |
| JP | 2005-188831 | A | 7/2005 |
| JP | 2007-064623 | A | 3/2007 |
| JP | 2009-276023 | A | 11/2009 |
| JP | 5174530 | B2 | 4/2013 |
| JP | 2015-031501 | A | 2/2015 |
| JP | 2016-035342 | A | 3/2016 |
| KR | 2010-0001506 | A | 1/2010 |

OTHER PUBLICATIONS

International Search Report dated Jul. 9, 2019, issued in corresponding International Application No. PCT/JP2019/017198 (and English Machine Translation).
Office Action dated Mar. 30, 2022 issued in corresponding TR Patent Application No. 2021/015612 (and English translation).
Office Action dated Oct. 10, 2023 issued in corresponding DE Patent Application No. 112019007253.6 (and English translation).

* cited by examiner

HEAT-EXCHANGER FIXING PLATE AND INDOOR UNIT OF AIR-CONDITIONING APPARATUS

CROSS REFERENCE TO RELATED APPLICATION

This application is a U.S. National Stage Application of International Application No. PCT/JP2019/017198, filed on Apr. 23, 2019, the contents of which are incorporated herein by reference.

TECHNICAL FIELD

The present disclosure relates to a heat-exchanger fixing plate to be used for fixing a heat exchanger of an air-conditioning apparatus to a housing, and also relates to an indoor unit of an air-conditioning apparatus.

BACKGROUND ART

Some heat exchanger included in an indoor unit of an air-conditioning apparatus is fixed to a heat-exchanger fixing plate located on at least one of the left and right side portions of the heat exchanger. The heat-exchanger fixing plate is fixed to a housing of the indoor unit, so that the heat exchanger is held in the indoor unit (see, for example, Patent Literature 1). The heat-exchanger fixing plate disclosed in Patent Literature 1 is made of resin, and has insertion holes through which hairpin portions of heat transfer tubes are inserted, the hairpin portions protruding from the side portion of the heat exchanger. The heat-exchanger fixing plate is fixed to the heat exchanger by inserting the hairpin portions of the heat transfer tubes through the insertion holes. The heat-exchanger fixing plate fixed to the heat exchanger is fastened to a housing panel of the housing with screws inserted through round holes on fixing portions provided on the heat-exchanger fixing plate, so that the heat exchanger is fixed to the housing.

CITATION LIST

Patent Literature

Patent Literature 1: Japanese Unexamined Patent Application Publication No. 2007-64623

SUMMARY OF INVENTION

Technical Problem

The housing panel of the indoor unit is detached from and attached to the heat-exchanger fixing plate at the time of parts replacement, maintenance, and other work. Each time the housing panel is detached and attached, the screws are removed and tightened. Due to this structure, the fixing portions of the heat-exchanger fixing plate with the housing panel are required to have a strength sufficient to withstand repeated screw tightening. However, in Patent Literature 1, the heat-exchanger fixing plate is only described as being made of resin, and the strength of the heat-exchanger fixing plate is not considered.

It is conceivable that a heat-exchanger fixing plate is made of high-strength material to improve the strength of the heat-exchanger fixing plate. However, depending on the material, the heat-exchanger fixing plate may expand and contract due to a temperature change during cooling operation or heating operation. This leads to a problem in that friction, generated between insertion holes and hairpin portions inserted through the insertion holes, may cause unusual noise.

The present disclosure has been made in view of such an issue, and it is an object of the present disclosure to provide a heat-exchanger fixing plate that makes it possible to reduce unusual noise, while improving the strength at a fixing portion of the heat-exchanger fixing plate with a housing panel, and also provide an indoor unit of an air-conditioning apparatus.

Solution to Problem

A heat-exchanger fixing plate according to one embodiment of the present disclosure is a heat-exchanger fixing plate to fix a side portion of a heat exchanger to a housing panel of an air-conditioning apparatus, the heat exchanger including a heat radiation fin and a heat transfer tube. The heat-exchanger fixing plate includes a heat-exchanger support portion facing the side portion of the heat exchanger, and having an insertion hole through which a hairpin portion of the heat transfer tube of the heat exchanger is inserted; and a housing-panel fixing portion formed separately from the heat-exchanger support portion and fitted to the heat-exchanger support portion, the housing-panel fixing portion being fastened with a screw to the housing panel such that the heat exchanger is fixed to the housing panel. The housing-panel fixing portion is made of material having a higher mechanical strength than a mechanical strength of material of which the heat-exchanger support portion is made, and the heat-exchanger support portion is made of the material having a lower friction coefficient than a friction coefficient of the material of which the housing-panel fixing portion is made.

Advantageous Effects of Invention

According to one embodiment of the present disclosure, the housing-panel fixing portion fastened with a screw to the housing panel such that the heat exchanger is fixed to the housing panel is formed separately from the heat-exchanger support portion, and the housing-panel fixing portion is made of material having a higher mechanical strength than a mechanical strength of material of which the heat-exchanger support portion is made. This can improve the strength of a fixing portion of the heat-exchanger fixing plate with the housing panel. As the heat-exchanger support portion is made of material having a lower friction coefficient than a friction coefficient of material of which the housing-panel fixing portion is made, unusual noise can be reduced compared to the case where the heat-exchanger support portion is made of material that is the same as that of the housing-panel fixing portion.

DESCRIPTION OF EMBODIMENTS

Embodiment

Figure 1:
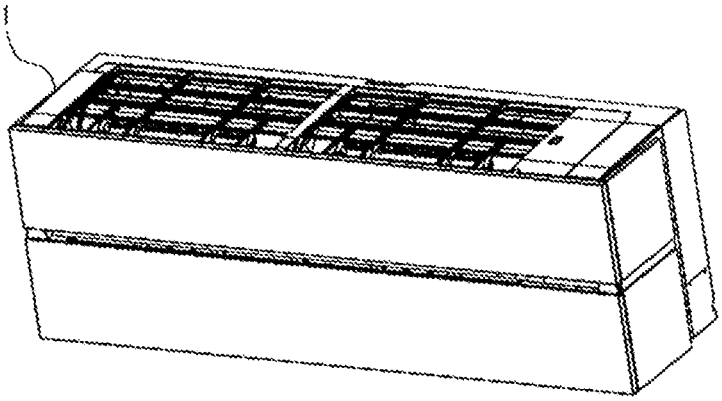
FIG. 1 is an overall perspective view of an indoor unit of an air-conditioning apparatus according to an embodiment.
Figure 2:
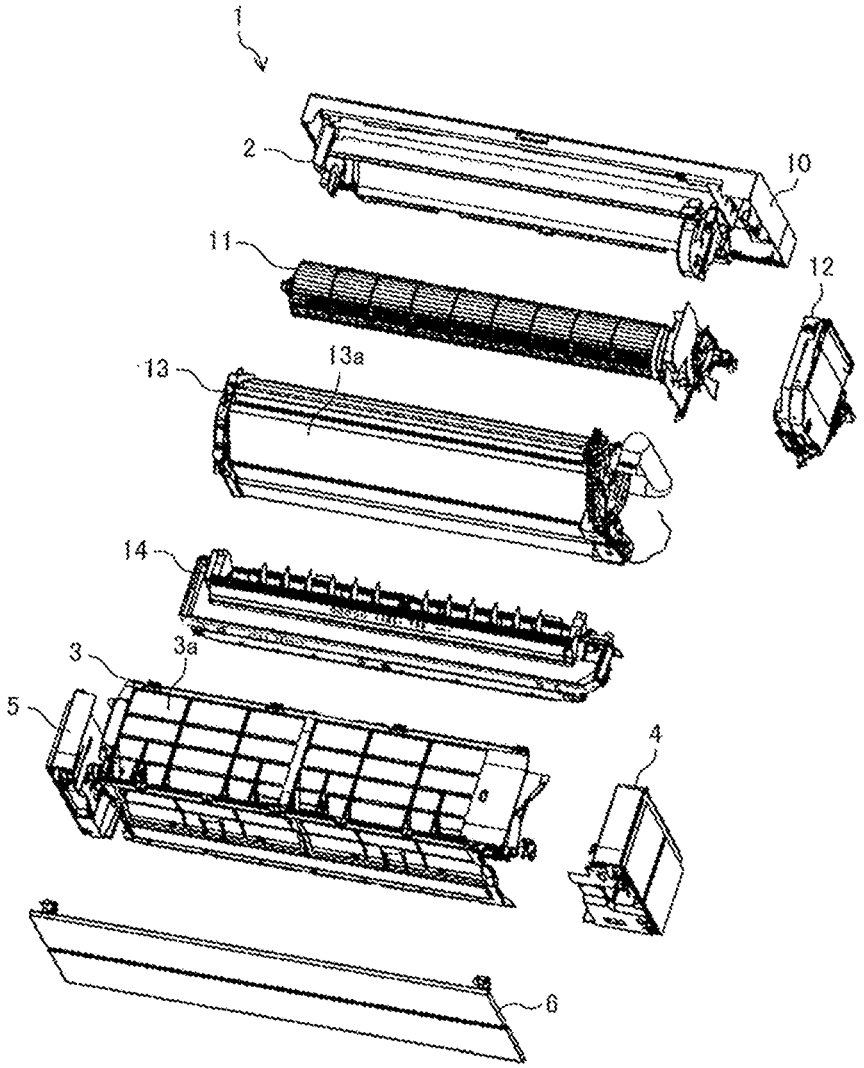
FIG. 2 is an exploded perspective view of the entirety of the indoor unit of an air-conditioning apparatus according to the embodiment.

FIG. 1 is an overall perspective view of an indoor unit of an air-conditioning apparatus according to an embodiment. FIG. 2 is an exploded perspective view of the entirety of the indoor unit of an air-conditioning apparatus according to the embodiment. Note that the terms "upper," "lower," "right," "left," "front," and "rear" used in the following descriptions are defined with reference to the installation state shown in FIG. 1.

A housing 10 of an indoor unit 1 includes a back casing 2 to be mounted on a wall surface, a top panel 3, a right side panel 4, a left side panel 5, and a front design panel 6. Hereinafter, these panels are sometimes collectively referred to as "housing panel" when these panels are not distinguished from each other.

In the housing 10, a fan 11, an electrical component box 12, a heat exchanger 13, and a drain pan 14 to receive condensed water generated in the heat exchanger 13 are located.

In the top panel 3, an air inlet 3*a* is formed to be used as an entrance into the indoor unit 1 for airflow generated by rotations of the fan 11. The drain pan 14 has an air outlet (not illustrated) that is used as an exit for the airflow.

The heat exchanger 13 exchanges heat between refrigerant and indoor air suctioned from the air inlet 3*a* to cool or heat the indoor air. The heat exchanger 13 is a fin-and-tube heat exchanger, and includes heat radiation fins 13*a* and heat transfer tubes 13*b* (see FIG. 3 described later) made up of, for example, copper pipes. In the heat exchanger 13, the end portions of the heat transfer tubes 13*b* adjacent to each other are bent into a hairpin shape of a hairpin portion 13*c* (see FIG. 3 described later).

In the indoor unit 1 configured as described above, when the fan 11 rotates, indoor air is suctioned from the air inlet 3*a*, and the suctioned indoor air passes through the heat exchanger 13 to be cooled or heated. The cooled air or heated air is then discharged from the air outlet into the room to cool or heat the room.

Figure 3:
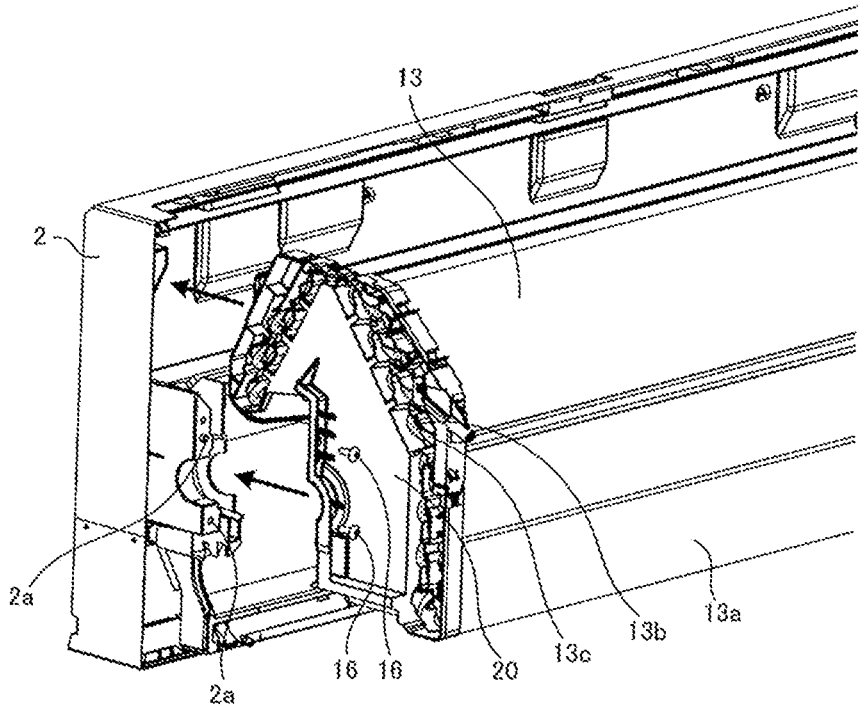
FIG. 3 is an explanatory perspective view illustrating a fixing structure of the heat exchanger according to the embodiment to a back casing.

FIG. 3 is an explanatory perspective view illustrating a fixing structure of the heat exchanger according to the embodiment to the back casing.

A heat-exchanger fixing plate 20 is fixed to the left side portion of the heat exchanger 13. At the time of fixing the heat exchanger 13 to the back casing 2, the heat exchanger 13 along with the heat-exchanger fixing plate 20 is inserted into the back casing 2 in the direction of arrows. Then, screws 16 are inserted into through holes (not illustrated) provided in the heat-exchanger fixing plate 20, and tightened into screw holes 2*a* provided in the back casing 2, so that the heat exchanger 13 is fixed to the back casing 2.

Figure 4:
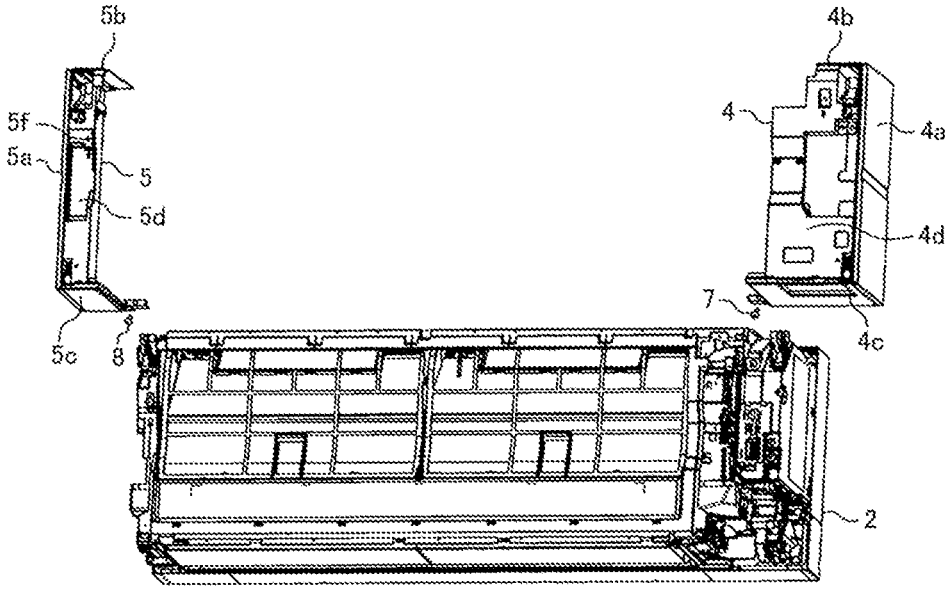
FIG. 4 is an explanatory perspective view illustrating a fixing structure of a right side panel and a left side panel of the indoor unit according to the embodiment to the back casing.

FIG. 4 is an explanatory perspective view illustrating a fixing structure of the right side panel and the left side panel of the indoor unit according to the embodiment to the back casing.

The right side panel 4 and the left side panel 5 are each made up of a resin-molded plate-like part. The right side panel 4 includes a base portion 4*a* facing the right side portion of the heat exchanger 13, and flange portions extending from the upper edge, the lower edge, and the front edge of the base portion 4*a* toward the leftward direction. The flange portions include an upper flange 4*b*, a lower flange 4*c*, and a front flange 4*d*. The left side panel 5 includes a base portion 5*a* facing the left side portion of the heat exchanger 13, and flange portions extending from the upper edge, the lower edge, and the front edge of the base portion 5*a* toward the rightward direction. The flange portions include an upper flange 5*b*, a lower flange 5*c*, and a front flange 5*d*.

The right side panel 4 is fixed to the back casing 2 by engaging a latch (not illustrated) provided on the right side panel 4 with an engagement portion (not illustrated) formed on the back casing 2, and further screwing the right side panel 4 to the back casing 2. The right side panel 4 is opened on the left side, and has low rigidity. Thus, the support force of the back casing 2 is insufficient for the moment in the leftward-rightward direction when the right side panel 4 is only latched to the back casing 2. Accordingly, to prevent the right side panel 4 from being unlatched from the back casing 2 by some kind of impact and from being removed from the back casing 2, the far-side portion of the lower flange 4*c* of the right side panel 4 is fastened to the front lower portion of the back casing 2 with a screw 7 to increase the support force.

The same applies to the left side panel 5. The left side panel 5 is fixed to the back casing 2 by engaging a latch (not illustrated) provided on the left side panel 5 with an engagement portion (not illustrated) formed on the back casing 2, and further screwing the left side panel 5 to the back casing 2. The left side panel 5 is opened on the right side, and has low rigidity. Thus, the support force of the back casing 2 is insufficient for the moment in the leftward-rightward direction when the left side panel 5 is only latched to the back casing 2. Accordingly, to prevent the left side panel 5 from being unlatched from the back casing 2 by some kind of impact and from being removed from the back casing 2, the far-side portion of the lower flange 5*c* of the left side panel 5 is fastened to the front lower portion of the back casing 2 with a screw 8 to increase the support force. The front flange 5*d* of the left side panel 5 is provided with a through hole 5*f* to be used for fixing the left side panel 5 to the heat-exchanger fixing plate 20.

Next, the heat-exchanger fixing plate 20, which is a characteristic part of the present embodiment, is described.

Figure 5:
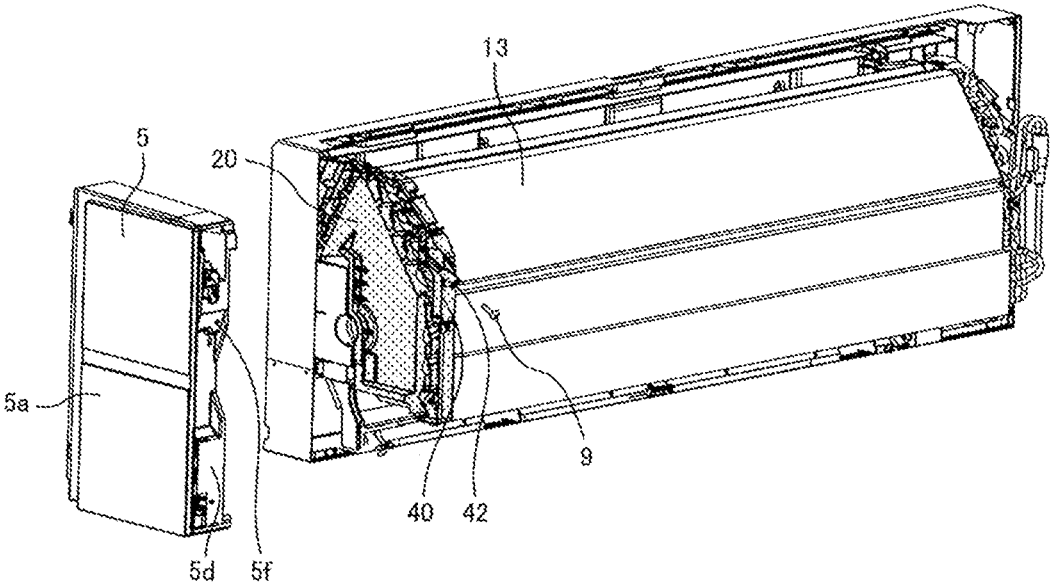
FIG. 5 is an explanatory perspective view illustrating a fixing structure of the left side panel and the heat-exchanger fixing plate according to the embodiment.
Figure 6:
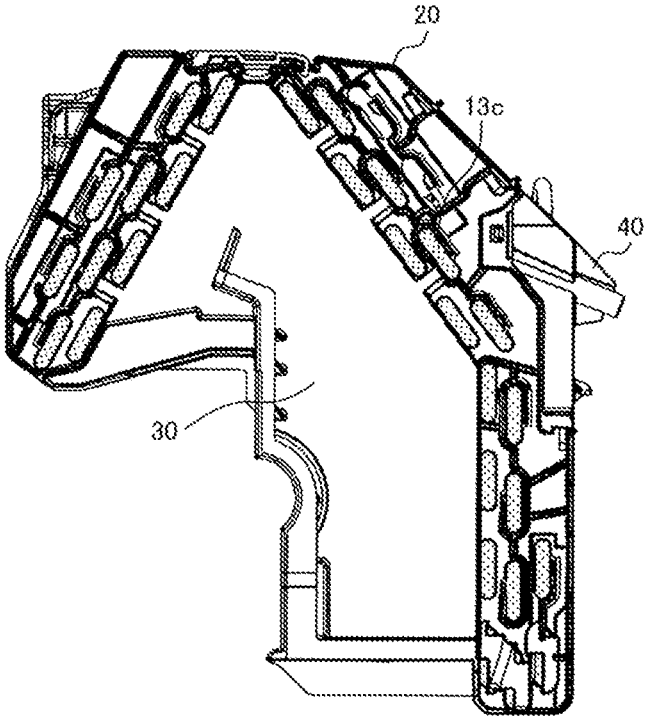
FIG. 6 is a side view of the heat-exchanger fixing plate according to the embodiment in a state of being fixed to a left side portion of the heat exchanger.

FIG. 5 is an explanatory perspective view illustrating a fixing structure of the left side panel and the heat-exchanger fixing plate according to the embodiment. A dotted section in FIG. 5 illustrates the heat-exchanger fixing plate. FIG. 6 is a side view of the heat-exchanger fixing plate according to the embodiment in a state of being fixed to a left side portion of the heat exchanger. Dotted sections in FIG. 6 illustrate the hairpin portions 13*c* of the heat exchanger 13.

Figure 7:
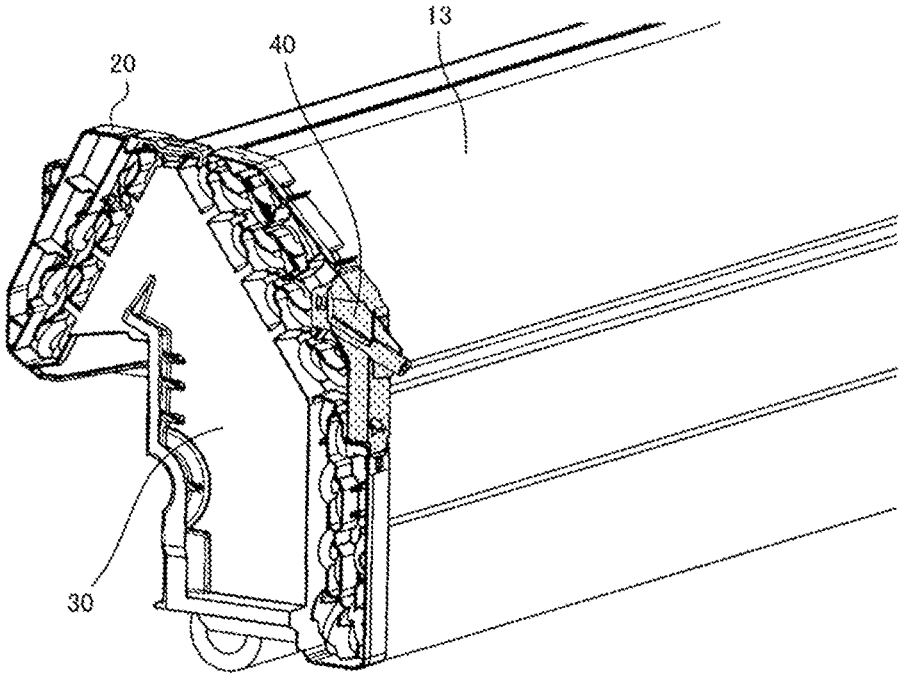
FIG. 7 is a perspective view of the heat-exchanger fixing plate according to the embodiment in a state of being fixed to the left side portion of the heat exchanger.
Figure 8:
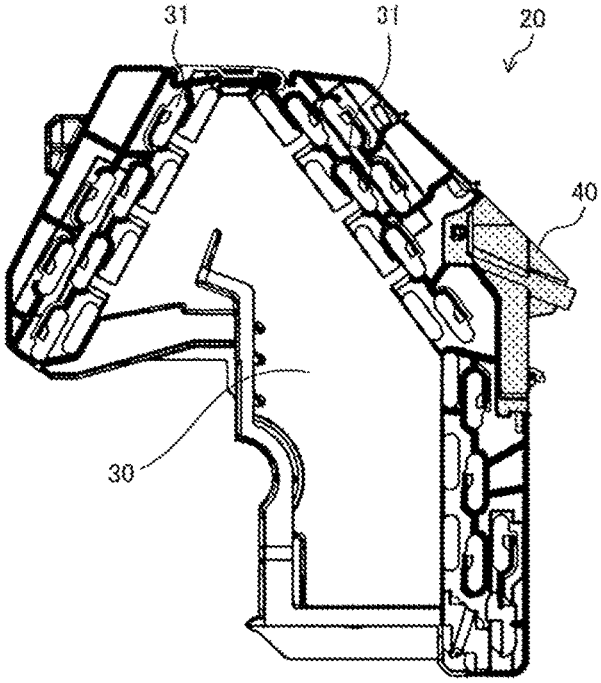
FIG. 8 illustrates the heat-exchanger fixing plate according to the embodiment when the heat-exchanger fixing plate is viewed from the exposed side.
Figure 9:
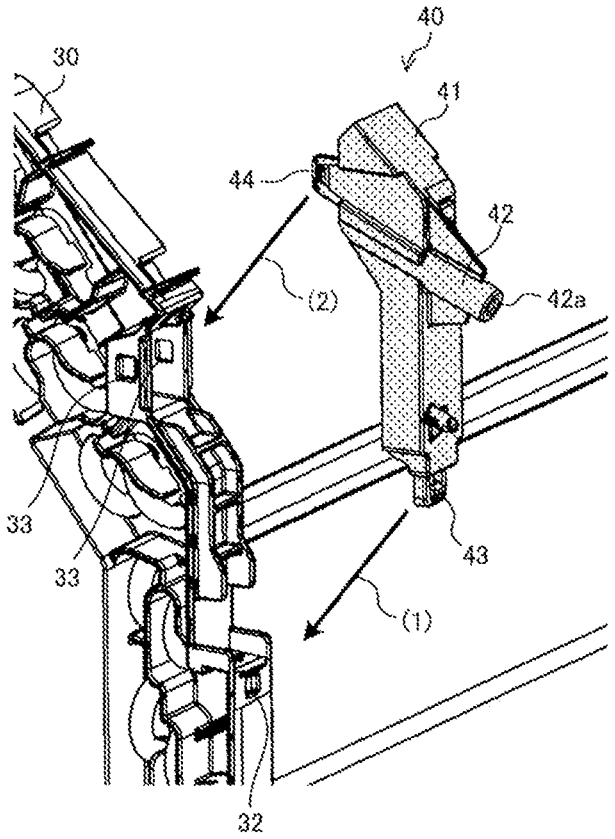
FIG. 9 is an enlarged perspective view of the heat-exchanger fixing plate with a housing-panel fixing portion removed from the heat-exchanger fixing plate in the state shown in FIG. 7.

FIG. 7 is a perspective view of the heat-exchanger fixing plate according to the embodiment in a state of being fixed to the left side portion of the heat exchanger. FIG. 8 illustrates the heat-exchanger fixing plate according to the embodiment when the heat-exchanger fixing plate is viewed from the exposed side. Note that the exposed side of the heat-exchanger fixing plate 20 refers to one side opposite to another side of the heat-exchanger fixing plate 20 facing the left side portion of the heat exchanger 13. FIG. 9 is an enlarged perspective view of the heat-exchanger fixing plate with a housing-panel fixing portion removed from the heat-exchanger fixing plate in the state shown in FIG. 7.

The heat-exchanger fixing plate 20 includes a heat-exchanger support portion 30 to support the heat exchanger 13 with the hairpin portions 13*c* of the heat exchanger 13 inserted through the heat-exchanger support portion 30, and a housing-panel fixing portion 40 to be used for fixing the heat-exchanger fixing plate 20 to the left side panel 5, which is the housing panel. In FIGS. 7 to 9, the dotted section illustrates the housing-panel fixing portion 40, while the other section illustrates the heat-exchanger support portion 30.

The present embodiment is characterized in that the housing-panel fixing portion 40 is formed separately from the heat-exchanger support portion 30, and is made of material having a higher mechanical strength than a mechanical strength of material of which the heat-exchanger support portion 30 is made, while the heat-exchanger support portion 30 is made of the material having a lower friction coefficient than a friction coefficient of the material of which the housing-panel fixing portion 40 is made.

Hereinafter, the respective structures of the heat-exchanger support portion 30 and the housing-panel fixing portion 40 will be described.

As shown in FIG. 8, the heat-exchanger support portion 30 has insertion holes 31 through which the hairpin portions 13*c* of the heat transfer tubes 13*b* of the heat exchanger 13 are inserted. The heat-exchanger support portion 30 is fixed to the heat exchanger 13 with the hairpin portions 13*c* of the heat transfer tubes 13*b* inserted through the insertion holes 31. As shown in FIG. 9, the heat-exchanger support portion 30 includes a lower engagement portion 32 with which a lower engagement latch 43 of the housing-panel fixing portion 40 is engaged, and a pair of left and right upper engagement portions 33 with which a pair of left and right upper engagement latches 44 of the housing-panel fixing portion 40 is engaged. The lower engagement latch 43 and the pair of left and right upper engagement latches 44 will be described later. The lower engagement portion 32 and the pair of upper engagement portions 33 are not limited to having a particular structure. It suffices that the lower engagement portion 32 and the pair of upper engagement portions 33 are formed to be engaged with the lower engagement latch 43 and the pair of upper engagement latches 44 of the housing-panel fixing portion 40 such that the lower engagement latch 43 and the pair of upper engagement latches 44 are detachable.

As shown in FIG. 9, the housing-panel fixing portion 40 includes a body portion 41, an annular attachment portion 42 protruding forward from the body portion 41 the lower engagement latch 43 protruding downward from the body portion 41, and the pair of left and right upper engagement latches 44 protruding rearward from the body portion 41. Note that FIG. 9 does not illustrate one of the pair of left and right upper engagement latches 44 that is an upper engagement latch 44 on the right side because of the angle of the perspective view. In the inner circumferential surface of the attachment portion 42, a screw hole 42*a* is provided into which the screw 9 is tightened.

In order that the housing-panel fixing portion 40 is fitted to the heat-exchanger support portion 30, first the lower engagement latch 43 is engaged with the lower engagement portion 32 of the heat-exchanger support portion 30 as shown by an arrow (1) in FIG. 9. Next, as shown by an arrow (2) in FIG. 9, the pair of left and right upper engagement latches 44 is engaged with the pair of left and right upper engagement portions 33 of the heat-exchanger support portion 30. This allows the housing-panel fixing portion 40 to be fitted to the heat-exchanger support portion 30.

As shown in FIG. 5, the heat-exchanger support portion 30 configured as described above is fixed to the left side panel 5 by inserting the screw 9 through the through hole 5*f* provided in the front flange 5*d* of the left side panel 5, and tightening the screw 9 into the screw hole 42*a* (see FIG. 9) of the attachment portion 42 of the housing-panel fixing portion 40. The left side panel 5 is repeatedly detached from and attached to the heat-exchanger fixing plate 20 for the purposes of parts replacement, maintenance, and other work. Each time the left side panel 5 is detached from and attached to the heat-exchanger fixing plate 20, fastening with the screw 9 is repeated. In view of this, the housing-panel fixing portion 40 is made of Acrylonitrile Butadiene Styrene (ABS) resin so that the housing-panel fixing portion 40 can ensure a strength sufficient to withstand repeated screw fastening with the left side panel 5.

Note that in the case where the entirety of the heat-exchanger fixing plate 20 is made of ABS resin, when there is a temperature change during cooling operation or heating operation, the hairpin portions 13*c* contact the peripheral walls inside the insertion holes 31, through which the hairpin portions 13*c* are inserted, due to a difference in thermal expansion coefficient between the hairpin portions 13*c* and the peripheral walls. In this case, unusual noise is generated, such as rubbing sound produced by friction. There are countermeasures against the unusual noise, such as application of lubricant to the heat-exchanger fixing plate 20. However, as the heat-exchanger fixing plate 20 has a complicated shape, this leads to a workability problem in applying lubricant to the heat-exchanger fixing plate 20. Therefore, application of lubricant to the heat-exchanger fixing plate 20 is not preferable as countermeasures against the unusual noise.

In view of this, in the present embodiment, the heat-exchanger support portion 30 is made of polypropylene (PP) resin, Although PP resin has a lower mechanical strength compared to ABS resin, PP resin has a low friction coefficient and thus can be expected to be effective in reducing the unusual noise. Due to this configuration, the unusual noise can be reduced compared to the case where the heat-exchanger support portion 30 is also made of ABS resin similarly to the housing-panel fixing portion 40.

As described above, the present embodiment relates to the heat-exchanger fixing plate 20 to fix the side portion of the heat exchanger 13 to a housing panel of an air-conditioning apparatus, the heat exchanger 13 including the heat radiation fins 13*a* and the heat transfer tubes 13*b*. In the present embodiment, the left side panel 5 is shown as an example of the housing panel to be fixed to the heat-exchanger fixing plate 20. However, the housing panel to be fixed to the heat-exchanger fixing plate 20 may be the right side panel 4. The heat-exchanger fixing plate 20 of the present embodiment includes the heat-exchanger support portion 30 facing the side portion of the heat exchanger 13, and having the insertion holes 31 through which the hairpin portions 13*c* of the heat transfer tubes 13*b* of the heat exchanger 13 are inserted; and the housing-panel fixing portion 40 formed separately from the heat-exchanger support portion 30 and fitted to the heat-exchanger support portion 30, the housing-panel fixing portion 40 being fastened with a screw to the housing panel such that the heat exchanger 13 is fixed to the housing panel. The housing-panel fixing portion 40 is made of material having a higher mechanical strength than a mechanical strength of material of which the heat-exchanger support portion 30 is made. The heat-exchanger support portion 30 is made of the material having a lower friction coefficient than a friction coefficient of the material of which the housing-panel fixing portion 40 is made.

Due to this configuration, the heat-exchanger fixing plate 20 is capable of reducing unusual noise, while improving the fixing strength with the housing panel. As the heat-exchanger support portion 30 is made of material having a lower friction coefficient than a friction coefficient of material of which the housing-panel fixing portion 40 is made, the heat-exchanger fixing plate 20 can reduce unusual noise compared to the case where the heat-exchanger support portion 30 is made of material that is the same as that of the housing-panel fixing portion. There is no need to take countermeasures against unusual noise using lubricant. Thus, this can avoid the problem of workability that is required when lubricant is used.

In the present embodiment, the housing-panel fixing portion 40 is made of ABS resin.

As described above, the housing-panel fixing portion 40 can be made of ABS resin.

In the present embodiment, the heat-exchanger support portion 30 is made of PP resin.

As described above, the heat-exchanger support portion 30 can be made of PP resin.

In the present embodiment, the indoor unit 1 of an air-conditioning apparatus includes the heat-exchanger fixing plate 20 described above.

This configuration makes it possible to reduce unusual noise, while improving the strength at the fixing portion of the heat-exchanger fixing plate 20 with the housing panel.

REFERENCE SIGNS LIST

1: indoor unit, 2: back casing, 2*a*: screw hole, 3: top panel, 3*a*: air inlet, 4: right side panel, 4*a*: base portion, 4*b*: upper flange, 4*c*: lower flange, 4*d*: front flange, 5: left side panel, 5*a*: base portion, 5*b*: upper flange, 5*c*: lower flange, 5*d*: front flange, 5*f*: through hole, 6: front design panel, 7: screw, 8: screw, 9: screw, 10: housing, 11: fan, 12: electrical component box, 13: heat exchanger, 13*a*: heat radiation fin, 13*b*: heat transfer tube, 13*c*: hairpin portion, 14: drain pan, 16: screw, 20: heat-exchanger fixing plate, 30: heat-exchanger support portion, 31: insertion hole, 32: lower engagement portion, 33: upper engagement portion, 40: housing-panel fixing portion, 41: body portion, 42: attachment portion, 42*a*: screw hole, 43: lower engagement latch, 44: upper engagement latch

The invention claimed is:

1. A heat-exchanger fixing plate to fix a side portion of a heat exchanger to a housing panel of an air-conditioning apparatus, the heat exchanger including a heat radiation fin and a heat transfer tube, the heat-exchanger fixing plate comprising:

a heat-exchanger support portion facing the side portion of the heat exchanger, and having an insertion hole through which a hairpin portion of the heat transfer tube of the heat exchanger is inserted; and a housing-panel fixing portion formed separately from the heat-exchanger support portion, fitted to the heat-exchanger support portion, and detachably engaged with the heat-exchanger support portion, the housing-panel fixing portion being fastened with a screw to the housing panel such that the heat exchanger is fixed to the housing panel, the housing-panel fixing portion being made of material having a higher mechanical strength than a mechanical strength of material of which the heat-exchanger support portion is made, the heat-exchanger support portion being made of the material having a lower friction coefficient than a friction coefficient of the material of which the housing-panel fixing portion is made.

2. The heat-exchanger fixing plate of claim 1, wherein the housing-panel fixing portion is made of ABS resin.

3. The heat-exchanger fixing plate of claim 1, wherein the heat-exchanger support portion is made of PP resin.

4. An indoor unit of an air-conditioning apparatus, the indoor unit comprising the heat-exchanger fixing plate of claim 1.

5. The heat-exchanger fixing plate of claim 1, wherein the housing-panel fixing portion and the heat-exchanger support portion each include a respective plurality of engagement latches and engagement portions adapted to fit the housing-panel fixing portion to the heat-exchanger support portion.

* * * * *